United States Patent [19]

Lilleker et al.

[11] Patent Number: 4,940,388

[45] Date of Patent: Jul. 10, 1990

[54] COOLING OF TURBINE BLADES

[75] Inventors: Jonathan R. Lilleker, Leeds; Harry Henshaw; John L. Winter, both of Derby, all of England

[73] Assignee: Rolls-Royce plc, London, England

[21] Appl. No.: 437,900

[22] Filed: Nov. 17, 1989

[30] Foreign Application Priority Data

Dec. 7, 1988 [GB] United Kingdom ..... 8828541

[51] Int. Cl.[5] ..... F01D 5/08

[52] U.S. Cl. ..... 416/97 R

[58] Field of Search ..... 416/96 R, 97 R; 415/115, 116

[56] References Cited

U.S. PATENT DOCUMENTS

| | | | |
|---|---|---|---|
| 3,533,711 | 10/1970 | Mercher | 416/97 R |
| 4,073,599 | 2/1978 | Allen et al. | 416/97 R |
| 4,136,516 | 1/1979 | Corsmeier | 416/96 R |
| 4,462,754 | 7/1984 | Schofield | 416/97 R |

FOREIGN PATENT DOCUMENTS

| | | | |
|---|---|---|---|
| 241180 | 3/1987 | European Pat. Off. . | |
| 13201 | 1/1982 | Japan | 416/97 R |
| 202304 | 11/1983 | Japan | 416/97 R |
| 135605 | 7/1985 | Japan | 416/97 R |
| 1600109 | 4/1978 | United Kingdom . | |

OTHER PUBLICATIONS

European Patent No. 241,180, Oct. 1987.

*Primary Examiner*—Robert E. Garrett
*Assistant Examiner*—John T. Kwon
*Attorney, Agent, or Firm*—Cushman, Darby & Cushman

[57] ABSTRACT

In order to facilitate efficient use of high pressure cooling air in a turbine rotor blade its aerofoil has a triple-pass convoluted cooling air duct in its leading edge region, and a triple-pass convoluted cooling air duct in its mid-chord region, both of them being fed from a common high pressure inlet in the root of the blade. The trailing edge region has a single-pass duct fed by low pressure cooling air from an inlet located just under the blade platform. The shroud of the blade also has cooling air passages and these are fed from the ends of respective ones of the ducts. Air from the ducts also exits through rows of film cooling holes to film cool the concave flank of the aerofoil and through a row of holes in its trailing edge to remove heat from the thinner metal section in that area.

7 Claims, 3 Drawing Sheets

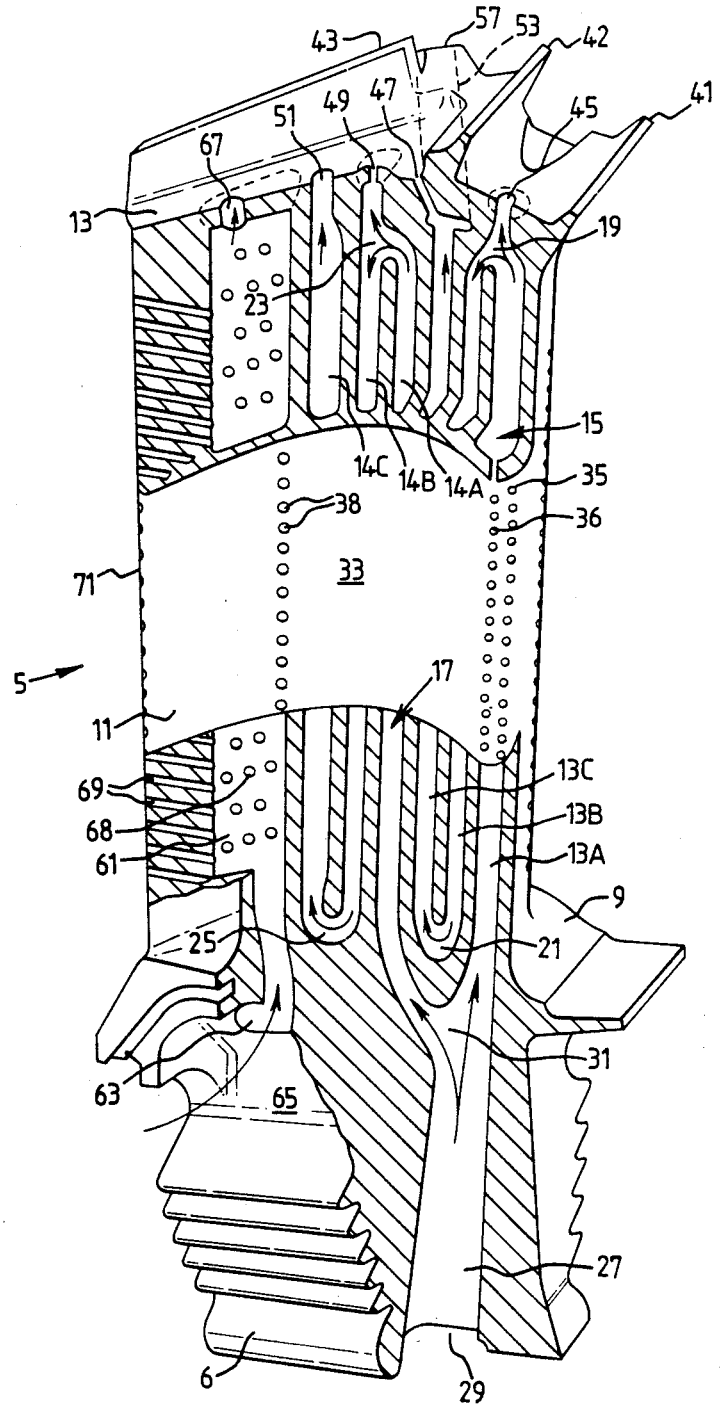
43
57
53
42
41
45
49
47
51
67
13
19
23
15
14C
14B
14A
35
38
36
33
71
5
17
11
13C
69
13B
68
13A
61
9
25
21
31
63
65
27
6
29

COOLING OF TURBINE BLADES

This invention relates to a cooled aerofoil-shaped turbine blade or vane for use in axial flow gas turbine engines.

Cooling of turbine blades and vanes in gas turbine aeroengines has become increasingly sophisticated in the last two decades and has enabled the superalloys of which such blades and vanes are generally made to give good service even while experiencing the increasingly high combustion gas temperatures necessary to maximise the thermodynamic efficiency of the engines. In aeroengines, such cooling is conventionally by means of air bled off from the engine's compressor and passed in convoluted passages through the interior of the blade or vane aerofoil in order to take as much heat as possible from its outer walls. By means of piercing the hottest parts of the flanks of the aerofoil, and its leading and trailing edges, with a large number of small holes, arranged in spanwise rows, which communicate with the interior of the aerofoil, it has also been possible to utilise the cooling air more efficiently by film-cooling the external surface of the aerofoil. Thus, heat has been removed from both the internal and external surfaces of the aerofoil.

In some of the more recently designed two- and three-spool aeroengines, it has become the practice to supply two grades of cooling air to the initial stage of turbine blades in the high pressure turbine, namely high pressure cooling air supplied from the high pressure compressor to a high pressure chamber defined between the turbine rotor and adjacent static structure, and low pressure cooling air comprising degraded air which has leaked, through seals from the high pressure chamber. Each blade or vane is designed to utilise both grades of cooling air, the high pressure air being utilised, in general, to cool the internal aerofoil surfaces near its leading edge where it is hottest and to supply most of the air for film cooling.

The problem in such designs is how to make maximum use of a minimum amount of cooling air in order to minimise the amount of work expended by the compressor in compressing the cooling air, this work of course being a debit to set against the increased amount of work extracted from the engine due to operation at higher turbine temperatures. A complicating fact which must be taken into account is that high pressure cooling air "costs" more than low pressure cooling air in terms of the work expended by the compressor to produce each unit volume of cooling air.

According to the present invention, an air cooled turbine blade for an axial flow gas turbine aeroengine has a root portion, an inner platform and an aerofoil, the aerofoil having a chordwise succession of substantially mutually parallel cooling air passages extending spanwise of the aerofoil, first and second pluralities of the passages being connected in flow series at their extremities to form respective separate first and second convoluted pathways in the leading edge and mid-chord regions of the aerofoil respectively, both said convoluted pathways being connected to a first cooling air entry port located below the inner platform, the trailing edge portion of the aerofoil having at least one spanwise extending cooling air passage therein connected to a second cooling air entry port located below the inner platform, in use the first entry port receiving cooling air at a high pressure and the second entry port receiving cooling air at a lower pressure.

The invention meets the above problem by enabling efficient use of the more costly high pressure cooling air for internal cooling in both the leading edge and mid-chord regions of the aerofoil, whilst not degrading its cooling abilities so much that it cannot be used for further cooling duties after passing through the convoluted pathways, at the same time utilising the less costly low pressure cooling air at least for internal cooling in the trailing-edge region of the aerofoil.

The first cooling air entry port mentioned above is preferably connected to that cooling air passage which is nearest the leading edge of the aerofoil in each of the convoluted paths of which they are a part.

Where the turbine blade has an integral outer platform or shroud with at least one shroud cooling air passage disposed therein to convey cooling air laterally across the shroud, such a cooling air passage may be advantageously connected to one of the convoluted pathways in the aerofoil to receive high pressure cooling air therefrom. Preferably, the shroud cooling air passage is connected to the end of the convoluted pathway.

The first and/or the second convoluted pathways may comprise three cooling air passages.

In order to accommodate our preferred modes of supply of high pressure and lower pressure cooling air, we prefer that the first entry port, which supplies high pressure cooling air to the first and second convoluted pathways, is at the base of the root portion of the blade, and that the second entry port, which supplies lower pressure cooling air to the at least one cooling air passage in the trailing edge region of the aerofoil, is at the top of the root portion of the blade, in or near the underside of the inner platform.

An embodiment of the invention will now be described, with reference to the accompanying drawings, in which:

FIG. 3 shows the turbine blade of FIG. 2 in a partly sectioned state.

Figure 1:
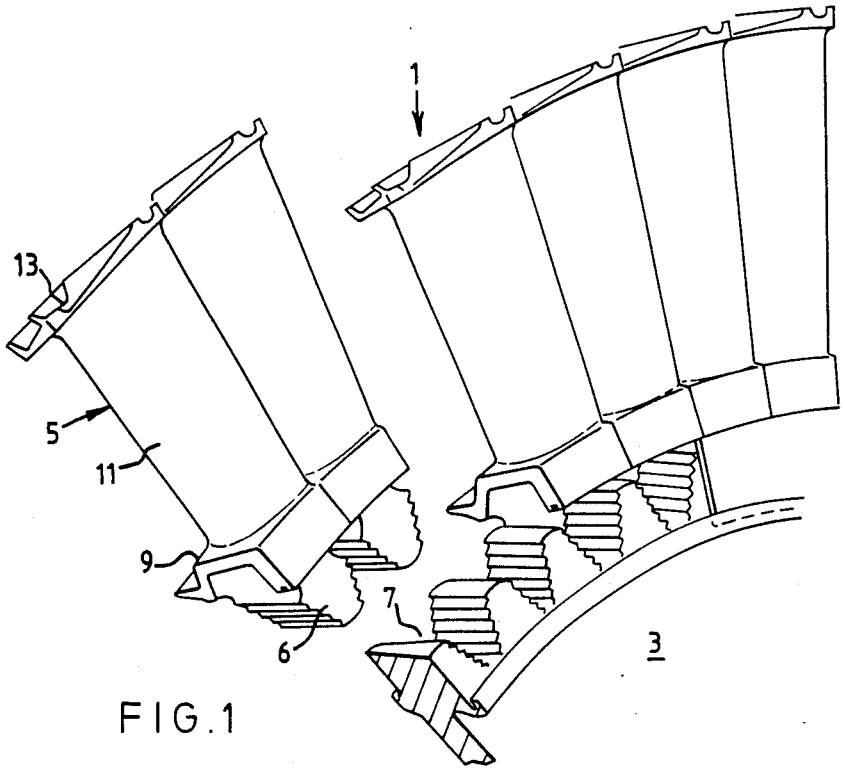
FIG. 1 is a perspective view of part of a typical turbine rotor for a gas turbine aeroengine, shown in a partly disassembled condition.

Referring to FIG. 1, a portion of the rotor stage 1 of a high pressure axial flow turbine comprises a rotor disc 3 having a large number of radially extending rotor blades 5 mounted around its periphery. Each rotor blade 5 comprises a root portion 6, having a so-called "fir-tree" sectional shape which locates in a correspondingly shaped slot 7 in the periphery of the rotor disc 3; a radially inner platform 9, which abuts the platforms of neighbouring blades to help define a gas passage inner wall for the turbine; an aerofoil 11, which extracts power from the gas flow past it; and an outer shroud portion 13 which again cooperates with its neighbours in the manner shown to help define the outer wall of the turbine's gas passage.

Figure 4:
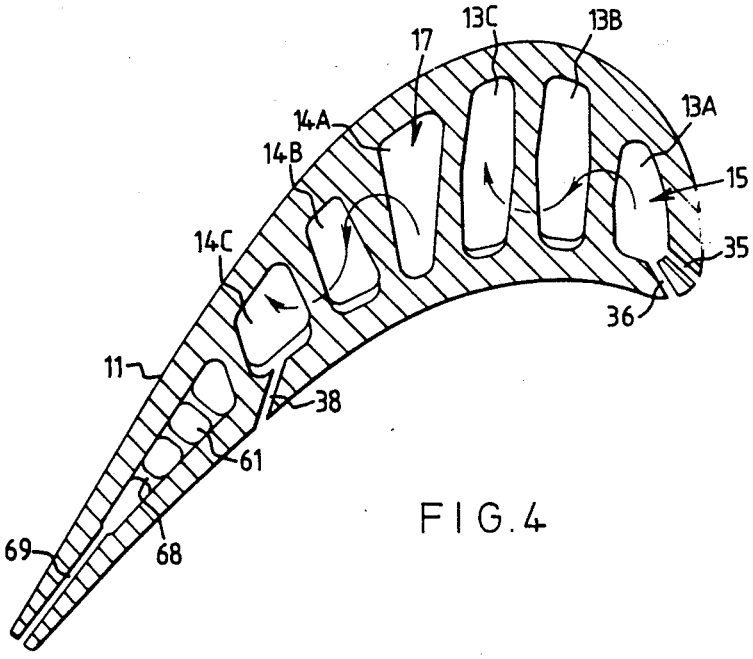
FIG. 4 is a cross-section of the turbine blade as seen on section line IV—IV in FIG. 2.
Figure 2:
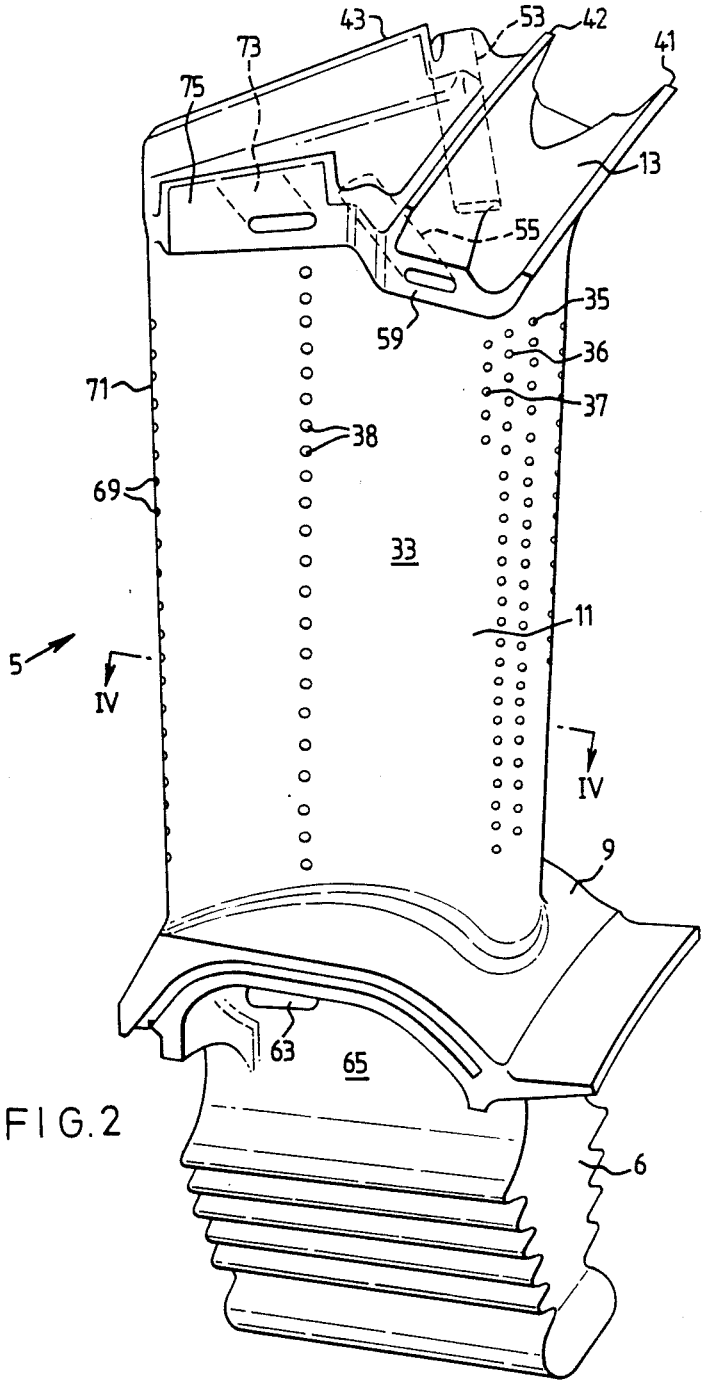
FIG. 2 is a more detailed perspective view of a turbine blade from the rotor of FIG. 1.

The detailed internal and external configuration of the turbine blade 5 is shown in FIGS. 2,3 and 4 and will now be described.

It can immediately be seen that the mid-chord and leading edge regions of the aerofoil 11 contain a chordwise succession of substantially mutually parallel cooling air passages 13,14 extending spanwise of the aerofoil and arranged in two sets of three, the members of each set being serially connected at their extremities to form two separate convoluted pathways 15,17 respectively for the cooling air. Thus, the first convoluted pathway 15 is in the leading edge region of the aerofoil 11 and comprises a passage 13A at the leading edge of the aerofoil, a passage 13B connected to passage 13A at its radially outer end 19, and a passage 13C connected to passage 13B at its radially inner end 21.

The second convoluted pathway 17 is in the mid-chord region of the aerofoil and comprises a passage 14A immediately adjacent passage 13C, a passage 14B connected to passage 14A at its radially outer end 23 and a passage 14C connected to passage 14B at its radially inner end 25. Both convoluted pathways 15,17 are connected, through a common passage 27 in the root portion 6 below the inner platform 9, to a cooling air entry port 29 located at the base of the root portion 6. Passage 27 is bifurcated at its outer end 31 just under platform 9 such that it conveys cooling air to the cooling air passages 13A, 14A, which are nearest to the leading edge of the aerofoil in their respective convoluted paths 15,17.

High pressure cooling air enters the blade 5 through the entry port 29 and cools the internal surfaces of the aerofoil 11 by virtue of its circulation around the passages 13 and 14. This is shown by the arrows in FIGS. 3 and 4. It is also utilised to film-cool the external surface of the concave flank 33 of the aerofoil by means of spanwise extending rows of film cooling holes 35 to 38. Holes 35 to 37 and holes 38 allow egress of cooling air from passages 13A and 14C respectively.

A further use for the high pressure cooling air is to cool the integral shroud 13. Some incidental cooling of the various fins 41,42 and 43 is achieved by exit of cooling air through small dust holes 45,47,49 and 51 which connect with the bends 19,23 between passages 13A,13B and 14A,14B, and with the outer ends of passages 13C, 14C; the dust holes are provided not only to enable cooling air flow through the passages but also so that small particles of environmental debris can be flung out of the passages instead of accumulating inside them. However, major cooling of the shroud is achieved by means of laterally extending passages 53,55 drilled across the shroud's width and breadth from the edge faces 57,59 respectively, these faces being part of the interlocking abutments between the shrouds of neighbouring blades. Passage 53 is drilled from shroud edge face 57 into the upper end of the passage 13C, passage 55 being drilled from edge face 59 into the upper end of passage 14C. Passage 55 ducts air from passage 14C into the small clearance between face 59 and the neighbouring shroud edge face in order to provide impingement cooling on the neighbouring shroud edge. However, passage 53 has its opening (not shown) in edge face 57 closed by means of welding and the cooling air exits from passage 53 through further film cooling holes (not shown) provided in the underside of the shroud 13, the film cooling holes being disposed so as to allow the air film they produce to flow over the region of the interlocking abutments. The shrouds are thereby subject to both film and impingement cooling by the high pressure cooling air. A similar alternative configuration for achieving such cooling of shrouds is disclosed in our copending patent application Ser. No. 396,058, filed Aug. 21, 1989.

The scheme of air cooling for the turbine rotor blade 5 is completed in the trailing edge region of the aerofoil 11 and shroud 13.

The trailing edge region of the aerofoil has a spanwise extending cooling air passage 61 which is connected to a second cooling air entry port 63 provided in the side face of an upper root shank portion 65 just below the underside of inner platform 9. This receives low pressure cooling air, which cools the aerofoil trailing edge region in two ways, viz:

(a) by taking heat from the internal surface of the aerofoil as it flows up passage 61 and out through, inter alia, the dust hole 67, heat exchange being facilitated by the provision of the small so-called "pedestals" or pillars 68 which extend between the opposing walls of the passage 61 across the passage's interior; and (b) by taking heat from the thinnest, most rearward, portion of the region, as the air flows out of passage 61 through the row of closely spaced small holes 69 which connect passage 61 to the actual trailing edge 71.

The region of the shroud 13 bordering on the trailing edge region of the aerofoil 11 is provided with a cooling air passage 73 which is drilled from shroud edge face 75 into the upper end of passage 61. Low pressure cooling air is ducted from passage 61 through passage 73 to the small clearance between face 75 and the neighbouring shroud edge face in order to provide impingement cooling on the neighbouring shroud edge.

We claim:

1. An air cooled turbine blade for an axial flow gas turbine aeroengine has a root portion, an inner platform and an aerofoil, the aerofoil having a chordwise succession of substantially mutually parallel cooling air passages extending spanwise of the aerofoil, first and second pluralities of the passages being connected in flow series at their extremities to form respective separate first and second convoluted pathways in the leading edge and mid-chord regions of the aerofoil respectively, both said convoluted pathways being connected to a first cooling air entry port located below the inner platform, the trailing edge portion of the aerofoil having at least one spanwise extending cooling air passage therein connected to a second cooling air entry port located below the inner platform, in use the first entry port receiving cooling air at a high pressure and the second entry port receiving cooling air at a lower pressure.

2. An air cooled turbine blade according to claim 1 in which the first cooling air entry port is preferably connected to that cooling air passage which is nearest the leading edge of the aerofoil in each of the convoluted paths.

3. An air cooled turbine blade according to claim 1 additionally having an integral shroud portion with at least one shroud cooling air passage disposed therein to convey cooling air laterally across the shroud, the shroud cooling air passage being connected to one of the convoluted pathways in the aerofoil to receive high pressure cooling air therefrom.

4. An air cooled turbine blade according to claim 3 in which the shroud cooling air passage is connected to the end of the convoluted pathway.

5. An air cooled turbine blade according to claim 1 in which the first convoluted pathway comprises three cooling air passages.

6. An air cooled turbine blade according to claim 1 in which the second convoluted pathway comprises three cooling air passages.

7. An air cooled turbine blade according to claim 1 in which the first entry port is at the base of the root portion of the blade and the second entry port is at the top of the root portion of the blade, in or near the underside of the inner platform.

* * * * *